United States Patent [19]

Nitschmann et al.

[11] 4,409,874

[45] Oct. 18, 1983

[54] SAW CHAIN FOR CHAIN SAWS, PARTICULARLY POWER CHAIN SAWS

[75] Inventors: Karl Nitschmann, Schorndorf; Hans Dolata; Gunter Dietzsch, both of Waiblingen, all of Fed. Rep. of Germany

[73] Assignee: Andreas Stihl, Waiblingen, Fed. Rep. of Germany

[21] Appl. No.: 226,731

[22] Filed: Jan. 21, 1981

[30] Foreign Application Priority Data

Jan. 22, 1980 [DE] Fed. Rep. of Germany ..... 3002138

[51] Int. Cl.[3] ..... B27B 17/00; B27B 33/14

[52] U.S. Cl. ..... 83/833; 83/522

[58] Field of Search ..... 83/522, 830–835; 76/25 A, 25 R; 308/1 A; 188/1.11

[56] References Cited

U.S. PATENT DOCUMENTS 1,949,670 11/1932 Winters ..... 188/1.11

3,587,516 6/1971 Wainscott ..... 188/1.11 X

FOREIGN PATENT DOCUMENTS 742935 9/1966 Canada ..... 83/830

*Primary Examiner*—James M. Meister

[57] ABSTRACT

A saw chain for chain saws, particularly portable power chain saws, comprising chain members which are pivotally connected with each other. At least some of the chain members are provided with a safety marking to show the extent of wear.

1 Claim, 4 Drawing Figures

SAW CHAIN FOR CHAIN SAWS, PARTICULARLY POWER CHAIN SAWS

The present invention relates to a saw chain for chain saws, particularly portable power chain saws, comprising chain links which are pivotally connected with each other.

The chain links or members of such saw chains of power chain saws are subject to wear as a consequence of being worn off and of being resharpened. This is true not only for the cutting chain members, but also for the non-cutting chain members. The cutting teeth wear out due to use, wearing-away, and resharpening, while non-cutting chain members, as for example depth limiters, wear out due to mere regrinding and further approximately horizontally extending lower edges of the chain members, as for example cutting members, connecting links, and the like, which during rotation of the chain slide upon the guide bar and/or are in direct driving connection with drive parts, for example the chain drive wheel or sprocket, wear out due to wearing-away.

With known saw chains, the operator cannot accurately determine whether the wear of the individual chain links, and hence of the entire chain, has reached the extent that operation of the power chain saw no longer appears feasible because of excessive wear of the chain links. This is also true for cutting chain links which are resharpened manually or by means of a sharpening device fastened on the power saw. As a consequence of such wear, accidents repeatedly occur during work with known power saws as a result of failure of saw chains. Frequently this results from the fact that the operator applies increased advancing pressure to a dull chain, as a result of which great wear occurs along the underside of the cutting teeth, and in the extreme situation can lead to wearing away of the material down to the rivets which connect the chain links with each other. In such a case, the profile of the respective chain links is weakened all the way to the rivet bore, to such an extent that cracks form which subsequently lead to failure of the chain.

The same disadvantage can arise due to depth limiters which are too high and are filed down by the operator of the saw in an improper manner to a height corresponding to that of the associated cutting tooth.

A further cause of chain failure is the situation of wearing-away that is too great due to the chain drive wheel or sprocket, the teeth of which mesh in recesses along the underside of the chain members, particularly the cutting teeth, and transmit the drive moment or torque to these chain members. This is also true for the connecting links located across from the cutting teeth.

Additionally, injuries to the saw operator can result if the remainder of the cutting teeth, which are filed too short, tear off or break down.

It is an object of the present invention to avoid these disadvantages, of known chains, which influence the safe operation of the chain saw, and furthermore to embody a saw chain in such a manner that the operator can easily recognize from which degree of wear on that it appears to be no longer feasible to further utilize the saw chain.

These and other objects and advantages of the present invention will appear more clearly from the following specification in connection with the accompanying drawing, in which:

FIG. 4 is a side view that shows safety markings provided on one connecting link.

The saw chain of the present invention is characterized primarily in that at least some of the chain links are provided with a safety marking to show the extent of wear.

When the material removal or wear occurring on the chain member, such as the cutting tooth, depth limiter, connecting link, etc., due to wear and/or resharpening is so far advanced that the safety marking is reached, then the operator of the chain saw can easily recognize that for safety reasons it is advisable to refrain from further use of a saw chain marked in this manner.

Such inventively provided safety markings can be applied at one or more locations of the chain members, particularly the cutting members, but also the depth limiters, the connecting links, and the like. These safety markings may be machined out of the material of the chain member, and in a preferred embodiment are in the form of a bead, fin, notch, groove, slot, cam, or the like. In this connection, it is particularly advantageous if for instance the beads or recesses are impressed or ground into the main body of the chain members of the chain saw. It is, however, also possible, by thermal treatment of the chain members, to also make the safety marking for instance also in color, and particularly, however, by laser beams or by spark arcing, preferably spark erosion, to make the safety markings in such a manner that they remain readily recognizable even after long use.

In accordance with further features of the inventive saw chain, the safety marking can be located on one or more cutting teeth. The safety marking may be located on the side surfaces of the chain member, or on the tooth top of one or more cutting teeth, in which case it preferably extends rearwardly at an incline relative to the cutting direction. The top marking may extend at the same angle as the top cutting edge, simultaneously forming a filing aid. One or more safety markings may be located at the transition from the side surface to the top of one or more cutting teeth 1.

A marking may be provided at the tooth face of one or more cutting teeth. This marking may be adapted to the path of the cutting edge face, preferably curved in such a manner that the curvature corresponds to the radius of curvature which results from the cutting angle and/or the shape of the sharpening tool, for instance a file.

A saw chain with chain members having cutting teeth and depth limiters may also have a marking on the depth limiter, the marking being spaced from the end or face surface of the depth limiter, and also at least nearly following the path of the upper edge of the depth limiter.

In the region of at least one of the base edges of the chain member, a marking may be provided which preferably extends parallel to that base edge. A further marking may be provided above a recess which is provided for meshing of the teeth of a chain-drive sprocket or toothed gear. Safety markings may also be provided on the connecting links of the chain.

Figure 1:
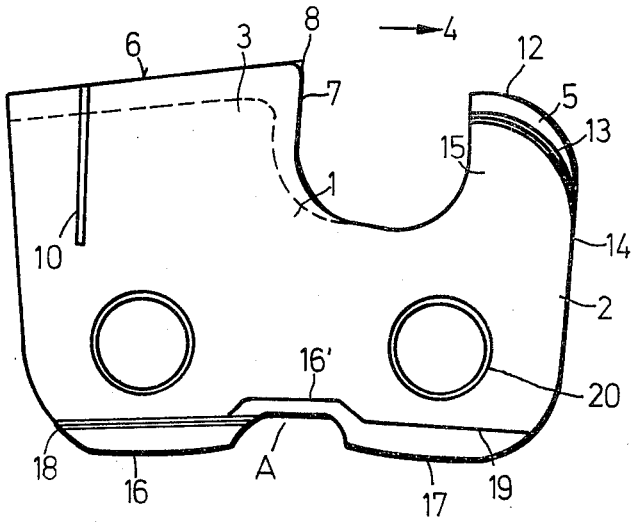
FIG. 1 is a side view of one embodiment of an inventive cutting member or link of a saw chain.
Figure 2:
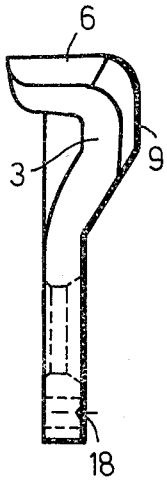
FIG. 2 shows the cutting member of FIG. 1 as seen in the direction of travel of the saw chain.

Referring now to the drawing in detail, the cutting member or link 1, which is reproduced in approximately five-times enlarged scale, has a flat base or main body 2 from which a cutting part 3 is formed by stamping and bending. When viewed in the direction of rotation (indicated by the arrow 4) of the saw chain, which is not illustrated in greater detail, and has several of such cutting members 1 associated therewith, this cutting part is located behind a depth limiter 5. The front part of the depth limiter 5 is rounded off, and the depth limiter itself, in contrast to the cutting part 3, extends in the same plane as the base body 2. The tooth body portion 2 has a leading edge (the right-hand edge of FIG. 1) and a trailing edge (the left-hand edge of FIG. 1) as well as leading and trailing round holes 20 for receiving connecting rivets.

Figure 3:
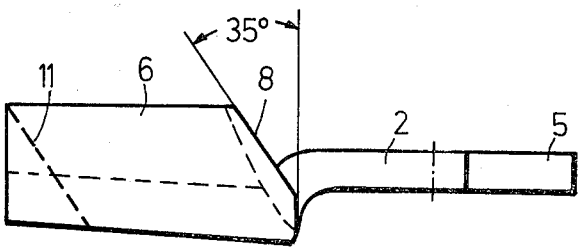
FIG. 3 is a plan view of the cutting member of FIGS. 1 and 2.

In order to attain or re-establish the desired high cutting capacity, the tooth top 6 and the tooth face 7 of the cutting member 1 which form a blade section of the tooth are conventionally refiled with a round file in such a way that a sharp cutting edge 8 results, which extends at an angle of approximately 35° transverse to the longitudinal direction of the cutting member or its working movement 4 (FIG. 3).

To indicate the degree of wear to the user of the power chain saw, and to let him know that further use of the saw chain is no longer feasible, several safety markings 10, 11, 18 are provided on the illustrated cutting member 1. These safety markings can respectively be provided alternatively, or can be arranged in combination with each other.

The cutting tooth 1, at its bent-away or angled-off side surface 9 located at the outboard area of the body portion 2, has a marking 10 in the form of a milled-out or ground-out, or impressed groove which extends to the tooth top 6, with the base of the groove being rounded out to avoid a notch effect.

The marking 10, in the region of the tooth face or a side of the cutting tooth, can extend at an incline or in a curved manner; for example, the marking can be adapted to the shape of a sharpening tool, for instance a file or a grinding wheel.

In FIG. 3, the dashed line 11 indicates that a marking can also be located on the tooth top 6. Such marking extends at an incline to the direction of movement 4, and can form an aid for delimiting the resharpening of the cutting edge 8. In this case, the top marking can extend at the same angle as the cutting edge 8.

It is conceivable to provide one or more safety markings 10, 11 at the transition from the side surface 9 to the top 6 of the cutting tooth 1. Furthermore, it is conceivable to adapt the marking to the path of the cutting edge face 7. This can occur in such a manner that the marking is curved, this curvature resulting from the path of the cutting edge face 7 and/or from the cutting angle and/or the shape of the sharpening tool. The safety marking 10 is preferably a single groove and terminates just above the rear of the trailing rivet hole. The safety marking 10 is the second safety marking. The safety marking 11 extends across the flat section of the blade portion and is the third safety marking.

With saw chains having depth limiters, the height of which must be adapted by regrinding to the particular height to the associated cutting part 3, there can be provided advantageously a marking 13 which extends along the depth limiter 5 at a distance from the end surface 12 thereof, and which at least substantially follows the path of the upper edge of the depth limiter. In the illustrated embodiment, the marking 13 is embodied at the depth limiter as a notch and is arranged on one or both side surfaces 15 of the depth limiter 5. The marking 13 indicates to the operator during regrinding how far the depth limiter can, as a whole, be reground. The safety marking 13 is the fourth safety marking.

Since during the sawing operation also the base areas (base areas 16 and 17 in the present embodiment) of the chain links wear away, inventively safety markings 18 and 19 can also be provided, in these areas, and preferably extend parallel to the inboard base edges of the chain links. Furthermore, between the markings 18 and 19, further markings 16' can be provided above a recess A. This recess A is provided for the engagement of the teeth, of a non-illustrated chain drive wheel or sprocket, which transmit the drive moment or torque to the chain links. A considerable wearing-away due to the teeth of the chain drive wheel results in this region, so that the marking 16' provided at this location is particularly important. This set of markings is the first set of markings and generally follows the base edge of the tooth.

The safety markings can be in color and/or can be clearly emphasized by means of inserted chrome strips. It is also, however, generally sufficient if the safety markings are embodied as shiny places and are consequently distinguishable from their immediate surroundings.

The inventive safety markings 18' can also be arranged on the connecting links L of the chain. Such connecting links can, depending on the structure of the chain, for example also be respectively arranged in the chain structure laterally adjoining a right or left cutting link, or as a connection to a so-called link.

The present invention is, of course, in no way restricted to the specific disclosure of the specification and drawing, but also encompasses any modifications within the scope of the appended claims.

What we claim is:

1. A saw chain for chain saws, including portable power chain saws; said saw chain having pivotally interconnected saw chain links, including cutting teeth, wherein each cutting tooth includes a body portion having leading and trailing longitudinally spaced round rivet holes therein for receiving rivets which connect the cutting tooth to adjacent links in the saw chain, the body portion being defined by leading and trailing edges facing toward and away from the direction of travel of the tooth and an inboard base edge which includes a recess for receiving the teeth of a chain drive wheel; the body portion further including an outboard area having a depth limiter adjacent the leading edge, and a notch behind the depth limiter; the cutting tooth further including a blade portion located behind the notch and extending generally perpendicular to the body portion, the blade portion having a cutting edge facing the direction of travel of the tooth and a generally flat section extending back to the trailing edge of the body portion, the improvement being characterized by:

a first set of safety markings in the body portion extending generally parallel to the base edge and being spaced from the base edge by a distance approximating the depth of the recess; the first set of safety markings including a marking generally following the geometry of the recess and being spaced therefrom; the set of safety markings being formed by grooves in the body portion, wherein the safety markings provide an indication that the round holes which receive the connecting rivets are in danger of being worn into;

a second safety marking formed by a single groove in the body portion, the second safety marking extending down from the blade portion into the body portion at a location just to the rear of the trailing rivet hole, the second safety marking terminating at a location above the trailing rivet hole;

a third safety marking extending across the flat section of the blade portion in spaced relation to the cutting edge and substantially parallel to the cutting edge, the third safety marking being a single groove having one end at the trailing edge of the flat section and the other end betwixt the cutting edge and trailing edge; whereby the second safety marking and the third safety marking provide an indication of the depth to which the tooth may be safely worn away when sharpening the tooth; and a fourth safety marking spaced from the outboard edge of the depth limiter and extending from the leading edge to a position spaced from the opening of the notch, the fourth safety marking being a single groove which curves in an arc approximating the arc of the engaging edge of the depth limiter whereby the fourth groove indicates when there is excessive wear of the depth limiter.

* * * * *